US005852851A

United States Patent [19]

Cooper

[11] Patent Number: 5,852,851

[45] Date of Patent: Dec. 29, 1998

[54] METHOD AND DEVICE FOR CONTAINING ARTICLES IN A BAG

[76] Inventor: Douglas W. Cooper, 5502 Rosser Rd., Stone Mountain, Ga. 30087

[21] Appl. No.: 274,383

[22] Filed: Jul. 13, 1994

[51] Int. Cl.[6] ..... B65D 77/10; A44B 21/00

[52] U.S. Cl. ..... 24/30.5 R; 24/305 P; 24/30.5 S; 383/6; 294/170

[58] Field of Search ..... 24/30.5 R, 30.5 S, 24/563, 545, 555, 570; 383/6, 7, 48, 49, 76; 294/158, 170

[56] References Cited

U.S. PATENT DOCUMENTS

| | | | |
|---|---|---|---|
| 1,564,101 | 12/1925 | Nakamura | 383/6 X |
| 2,396,906 | 3/1946 | Windson | 24/30.5 S X |
| 2,907,586 | 10/1959 | Paxton et al. | 24/30.5 S |
| 2,981,990 | 5/1961 | Balderree, Jr. | 24/30.5 |
| 3,822,441 | 7/1974 | Paxton | 24/30.5 |
| 4,361,935 | 12/1982 | Paxton | 24/30.5 R |
| 4,509,231 | 4/1985 | Paxton | 24/30.5 R |
| 4,694,542 | 9/1987 | Koppe | 24/30.5 S |
| 4,772,059 | 9/1988 | Parry et al. | 294/170 |
| 4,783,886 | 11/1988 | Koppe | 24/35.5 R X |
| 4,896,366 | 1/1990 | Oxman | 383/71 |
| 4,911,293 | 3/1990 | Holmes | 24/30.5 R X |
| 4,946,065 | 8/1990 | Goulter et al. | 383/6 X |
| 4,991,894 | 2/1991 | Rutens | 294/170 |
| 5,138,748 | 8/1992 | Welles | 24/30.5 S |
| 5,311,646 | 5/1994 | Eischen, Sr. | 24/30.5 |

FOREIGN PATENT DOCUMENTS

| | | | |
|---|---|---|---|
| 92010520 | 11/1992 | Australia | 294/170 |
| 2652563 | 4/1991 | France | 294/170 |
| 2270345 | 3/1994 | United Kingdom | 24/30.5 S |

*Primary Examiner*—Anthony Knight
*Assistant Examiner*—Robert J. Sandy
*Attorney, Agent, or Firm*—Richard C. McComas

[57] ABSTRACT

A clasp having a wafer-like body releasably holds together thin flexible handles of a bag for carrying articles. The body includes a pair of opposing lobes that define a channel extending from a peripheral edge to an interior aperture. A wall of the aperture defines two generally V-shaped niches, each on opposite sides of the channel adjacent the lobes. The handles of the bag, inserted through the channel to the interior aperture, engage the niches for holding the bag substantially closed when being operated for enveloping articles. A method of releasably maintaining an entrance of a bag substantially partially closed is also disclosed.

2 Claims, 4 Drawing Sheets

METHOD AND DEVICE FOR CONTAINING ARTICLES IN A BAG

TECHNICAL FIELD

The present invention relates to bags that contain articles. More particularly, the invention relates to a method of and an article for releasably holding handles of a bag enabling the bag to retain articles therein.

BACKGROUND OF THE INVENTION

Consumers shopping for groceries or other consumer products typically purchase numerous articles of varying shapes and sizes. Store personnel, either a cashier or bagger, usually place the articles in bags. Consumers may thereby more easily carry their articles from the store to their car and from their car to their home.

Typically the bags of choice for many consumers are plastic bags rather than paper bags. The plastic bags are made of a thin, flexible sheet of a high strength plastic material. The bags are generally rectangularly shaped having a seamed bottom and two cut-out handles on either side of an opening. The bags, when empty, collapse flatly. It is not until articles are placed into the bags and the handles elevated that the bags begin to hold a volumetric shape and function to envelop the articles therein. The shape is substantially determined by the contents in the bag. These plastic bags, however, do not satisfactorily contain the articles placed therein until both handles are grasped and the bag is lifted or suspended by the handles.

While achieving the purpose of enveloping articles, such plastic bags present problems to consumers. These problems are demonstrated by the typical scenario of purchasing groceries at a store and transporting the bagged groceries. After a consumer selects groceries, a store clerk at the grocery store typically places at least several of the articles within each plastic bag. The store clerk often places the bags within a shopping cart for transportation to a car in the parking lot. Even with care in placing the bags in the cart, bags may collapse around the articles opening the entrance and thereby allowing the articles to fall out. This necessitates re-bagging the articles and requires additional time and effort. Either the store clerk or the consumer pushes the cart of full bags out of the store through the store parking lot to the automobile. The wheels of the cart often do not roll smoothly due to the roughness of parking lot pavement resulting in the bags being jarred and jostled. The bags collapse, as before, around the articles and the articles may fall out of the bags, especially from bags which have been stacked one on top of another. The store clerk or the consumer re-bags any loose articles, picks up each of the bags and places each bag inside the automobile. During the ride home, the bags are often frequently subjected to stop and go driving action. Each jerk and bump of the automobile causes the bags of groceries to shift. By the time the consumer arrives home, the bags again collapse around the articles. The articles again exit their bags and are now spread within the automobile. The consumer, thus, must again re-bag the groceries prior to taking them inside the house. Typically, each time the groceries fall out of the bags, the handles of the bags have separated and must be located prior to re-bagging. Obviously, the nuisance, time and effort of re-bagging groceries over and over again presents a problem that needs to be solved.

Various solutions have been practiced to prevent the articles from falling out of the plastic bags, but these have not been entirely satisfactory. In some instances, bags are not filled fully. The thought is that if the articles are further from the opening, they would be less likely to come out of the bag. However, this solution does not solve the problem. No matter how few articles are in the bags, the jarring action of the automobile causes the bags to collapse around the articles making it very easy for the article to fall out. Also rounded articles easily roll out of the bags, even if just one such article is placed in the bag. The drawbacks to this solution is that more bags are used increasing overhead costs to the store without substantially resolving the problem.

Another solution has been to intertwine the two handles by looping them around each other several times. This may temporarily prevent the articles from falling out of the bag. However, substantial jarring of the bags, especially with full bags or those containing heavy articles, causes the twisted loops to come undone and the articles to fall out as before. This solution, if successful, adds time and effort to unpack the groceries in untangling the intertwined handles.

Another solution which has the effect of preventing the articles from escaping the bags involves tieing the handles of the bags together in knots. However, this solution has problems of its own. Just by picking up the bags, the weight of the articles therein causes the knots to tighten. The time and effort expended in untying the handles after the handles have been tightly knotted is an inconvenience in-of-itself. In some instances, the bags may have to be cut open which makes it difficult to use the bags for other purposes such as for holding trash or for disposal of wet diapers. Thus, there exists a need in the art for a method and device which more effectively prevents articles from falling out of bags which have collapsed, aids in carrying the bags, and yet conveniently allows opening of the bags for removal of the contained articles. Accordingly, it is to the provision of such an improved method and device that the present invention is primarily directed.

SUMMARY OF THE INVENTION

The present invention meets the need in the art for a method and device which more effectively prevents articles from falling out of bags which have collapsed. A clasp for releasably holding together thin flexible handles of a bag. The clasp has a wafer-like body with a pair of lobes that define a channel therebetween. The channel extends from an outer peripheral edge of the body to an interior aperture. The interior aperture has a wall defining at least one V-shaped niche on one sides of the channel adjacent one of the lobes. The handles insert through the channel to the interior aperture. The lobes guide the handles of the bag into the niche for holding the bag substantially closed when being operated for enveloping articles.

In another aspect the present invention provides a clasp having a wafer-like body releasably holds together thin flexible handles of a bag for carrying articles. The body is defined by an outer peripheral edge. Two interior generally C-shaped walls extend from the outer peripheral edge and are disposed in spaced-apart backward-facing mirrored relation to define a channel opening into an interior aperture in the body. Two generally V-shaped niches, each on opposite sides of the channel, are defined by an intersection of the C-shaped walls and a wall of the interior aperture. A portion of the C-shaped walls adjacent the niches defines arcuate guide surfaces for guiding handles of a bag into the niches. The handles insert through the channel to the interior aperture. The guide surfaces guide the handles of the bag into the niches for holding the bag substantially closed when being operated for enveloping articles.

The present invention further provides a method of releasably maintaining an entrance of a bag substantially partially closed. A pair of thin flexible handles of a bag are brought together and slid through a channel of a wafer-like clasp. The channel is defined by a pair of opposing lobes and extends from an outer peripheral edge of the clasp to an interior aperture having an aperture wall. Upon grasping the handles for operation of the bag for enveloping articles, each handle is guided by a respective one of the lobes into one of a pair of V-shaped niches in the aperture wall. Each niche is located on opposite sides of the channel adjacent each lobe. The bag, being substantially closed for enveloping articles, retains articles therein.

DETAILED DESCRIPTION OF THE INVENTION

Figure 1:
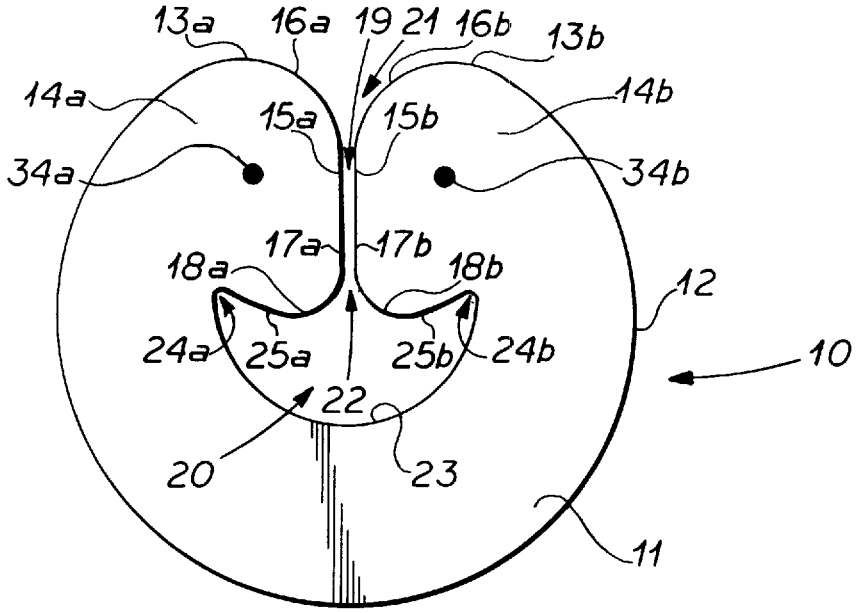
FIG. 1 is a top view of a clasp according to the present invention.

Referring now in more detail to the drawings in which like numerals indicate like parts, FIG. 1 illustrates a clasp 10 having a flat wafer-like body 11 and an outer peripheral edge 12 that defines a substantially circular perimeter. The outer peripheral edge 12 breaks and begins to curve inwardly at two points 13*a* and 13*b* to define two generally symmetrical lobes 14*a* and 14*b* of the body 11.

The perimeters of the lobes 14 define substantially C-shaped walls 15*a* and 15*b* extending from the respective break points 13. The C-shaped walls 15 are disposed in spaced-apart backward-facing mirrored relation. The C-shaped walls, as shown in the illustrated embodiment, are preferably arcuate but may also be angular. The C-shaped walls 15 have upper portions 16*a* and 16*b*, middle portions 17*a* and 17*b* and lower portions 18*a* and 18*b*. The middle portions 17 of the C-shaped walls 15 define a channel 19 which opens into an interior aperture 20 in the body 11. The channel 19 has a channel entrance 21 from outside the body 11 between the upper portions 16. The channel 19 has a channel exit 22 into the aperture 20 between the lower portions 18.

The aperture 20 has an aperture wall 23 which defines the substantially semi-circular opening in the body 11. An intersection of the aperture wall 23 and the lower respective portions 18 of the C-shaped walls 15 defines two generally V-shaped niches 24*a* and 24*b*, each on opposite sides of the channel 19. The lower portions 18 of the C-shaped walls 15 define guide surfaces 25*a* and 25*b* adjacent the niches 24. The guide surfaces 25 in the illustrated embodiment are arcuate.

Figure 2:
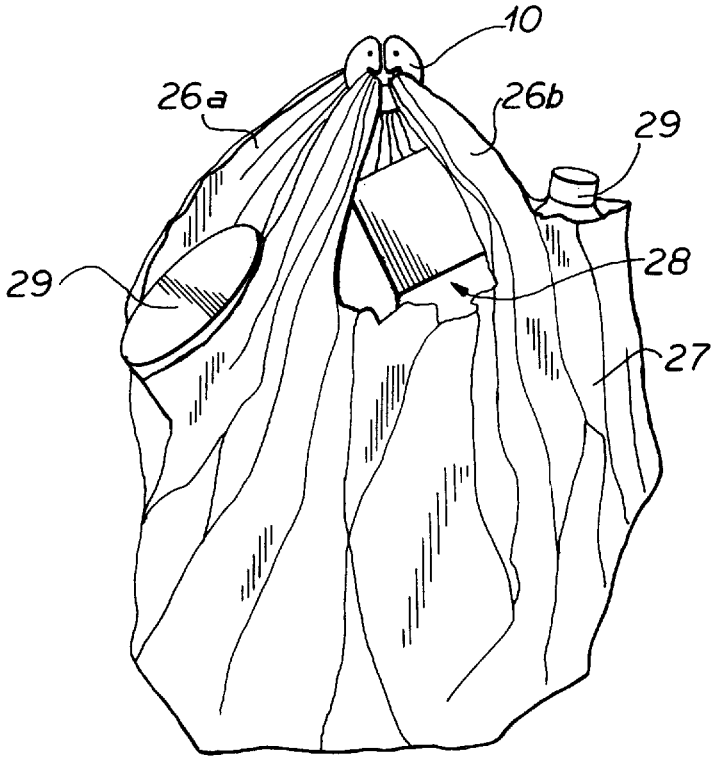
FIG. 2 is a perspective view of the clasp illustrated in FIG. 1 holding together handles of a flexible bag containing articles.
Figure 3:
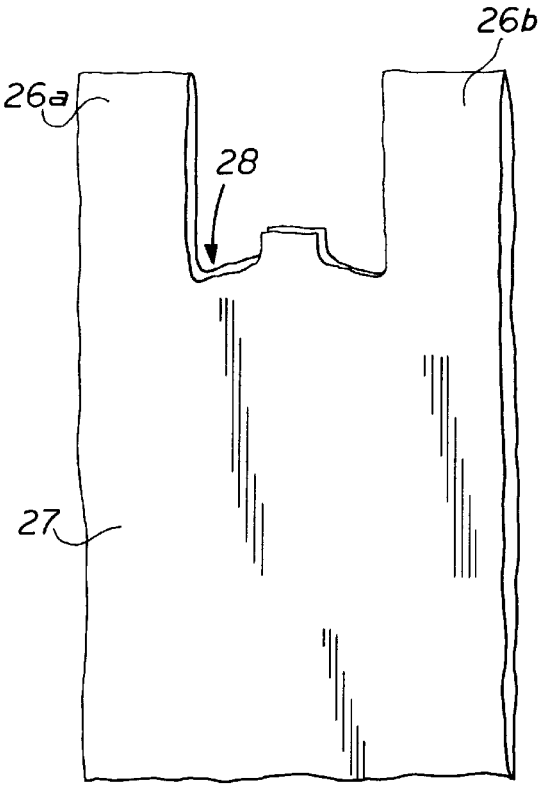
FIG. 3 is a front view of a flattened flexible bag having two cut-out handles and an opening.
Figure 4:
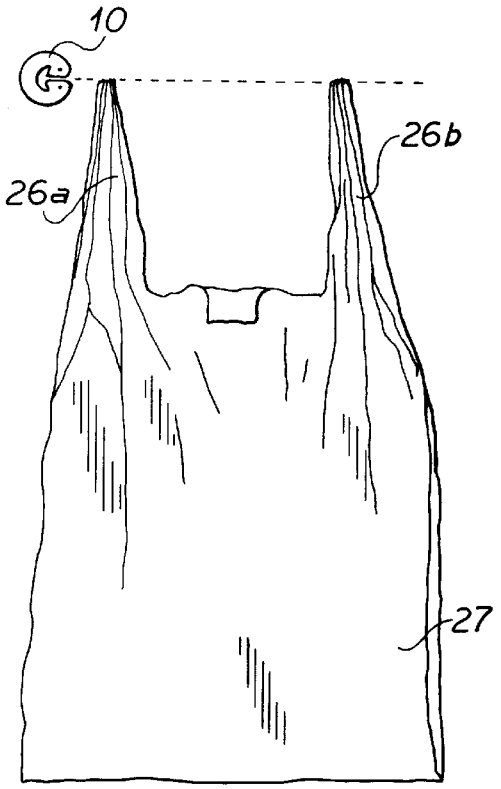
FIG. 4 is a front view of the bag of FIG. 3 with the handles being gathered together prior to installing the clasp, which is exploded away therefrom.
Figure 5:
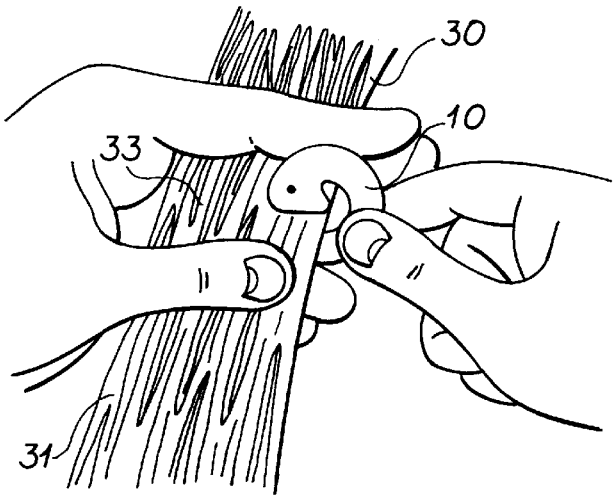
FIG. 5 is a top perspective view of the handles of the bag and the clasp being held during installation of the clasp.
Figure 6:
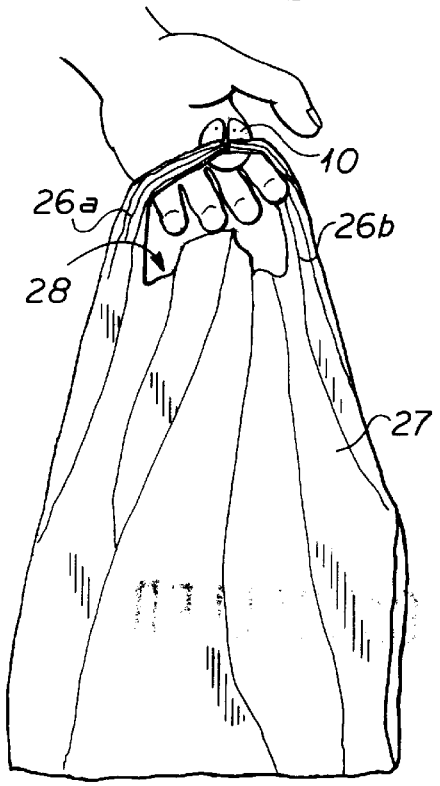
FIG. 6 is a perspective view of the bag being carried with the clasp engaging both handles.

With reference to FIG. 2, the clasp 10 releasably holds together thin flexible handles 26*a* and 26*b* of a bag 27 having an opening 28 for receiving articles 29 therein. In the illustrated embodiment, the handles 26 are integral with the bag 27. The handles 26 are web-like bands extending from the opening 28. The bag 27 and the handles 26 are made of a thin flexible sheet of plastic. When empty, the bag 27 is merely a sheet of collapsible plastic which generally falls over flatly. When containing articles, the bag 27 functions to envelop the articles 29 containing them therein. However, the articles 29 do not generally remain in the bag with even minimal movement or jarring due to the size of the opening 28. The bag 27 having no integral structure self-releases from the articles 29 ceasing to provide its enveloping function. Not until tension is applied on the handles 26, as when carrying the bag or hanging on a stand at the grocery store, will the bag 27 effectively surround the articles 29 to prevent the articles from falling out. The clasp 10 of the present invention holds the handles 27 together, in an associated spacial relationship that restrains the handles 27 from separating, thereby maintaining the opening 28 of the bag 27 substantially, partially closed. Thus, the bag 27 functions as a bag for containing articles. Further, the clasp 10 groups the handles 27 together making it easier to locate the handles when picking up the bag 27.

The installation of the clasp 10 on the handles 27 is described below with reference to FIGS. 3 through 6. The handles 26 are gathered together and held in one hand. A first portion 30 of the handles 26 is held between the forefinger and the middle finger, and a second portion 31 spaced-apart from the first portion 30 is held between the thumb and the ring finger. The clasp 10 is then held in the other hand substantially perpendicular to a spaced apart region 33 of the handles 26 such that the channel 19 is aligned with the gathered handles 26. Preferably, the clasp 10 is held between the thumb and forefinger of the other hand. With a sharp, quick movement of the hands, the handles 26 are then inserted into the aperture 20. The handles 26 slide into the channel entrance 21 and through the channel 19. The C-shaped walls 15 guide the handles 26 into the channel entrance 21. Once inside the aperture 20 the handles 26 relax from being gathered. The web-like handles 26 expand and are secured therein.

However, the handles 26 being thin may slip out of the clasp 10. Such is substantially prevented from occurring by the niches 24 in cooperation with the guide surfaces 25. In the illustrated embodiment the handles 26, once inside the aperture 20, are guided by the curvature of the guide surfaces 25 and the aperture wall 23 into the niches 24. The guide surfaces 25 slidingly induce the handles 26 into the niches 24. The niches hold the handles 26 in a spaced-apart relation causing the opening 28 of the bag 27 to remain substantially, partially closed thereby restricting egress of the articles 29 through the opening 28. Generally, a majority of the web-like handles 26 remains substantially in the niches providing additional security for keeping the handles 26 within the aperture 20. Even if a portion of the handles begins to slip through the channel, the remaining portions of the handles will be secure within the niches.

The removal of the clasp 10 from the handles 26 of the bag 27 is relatively simple. The handles 26 may be gathered together on one side of the clasp 10 and brought back through the channel entrance 21 into the aperture 20. A loop is formed from the handles 26 which is removed directly from the aperture 20. The handles 26 may also simply be removed by holding the handles on both sides of the clasp 10 and pulling the handles back through the channel 19 at the channel exit 22. The C-shaped walls 15 facilitate removal of the handles 26 from the clasp 10.

The clasp 10 is preferably made of plastic such as polystyrene or polyethylene. The wafer-like body 11 of the clasp 10 is preferably of a sufficient thickness to hold the weight of contents in the bag without flexing, twisting or breaking. A clasp made of polystyrene being 0.06 inches thick has been found to be effective.

The diameter of the body 11 may vary in size as long as the aperture is sufficiently wide to accommodate the handles 26 of the bag 27. The body 11 may also be non-circular, such as rectangular or triangular.

The clasp 10 may be used on any type of bag, such as paper or plastic, which has flexible handles for carrying. The handles may be integral with the bag as in conventional grocery store plastic bags described above. The handles may also be attached to the bag as in conventional oversized department store paper bags which have flexible plastic or twisted paper for handles.

For decorative purposes the lobes 14 may have printed dots, punctures, or indentations 34A and 34B to represent eyes of either a smiling face with the aperture 20 representing a mouth or a side view of two friends facing each other. The clasp 10 may also be of a contrasting color to the bag 27 so as to more easily locate the handles 26.

Figure 7:
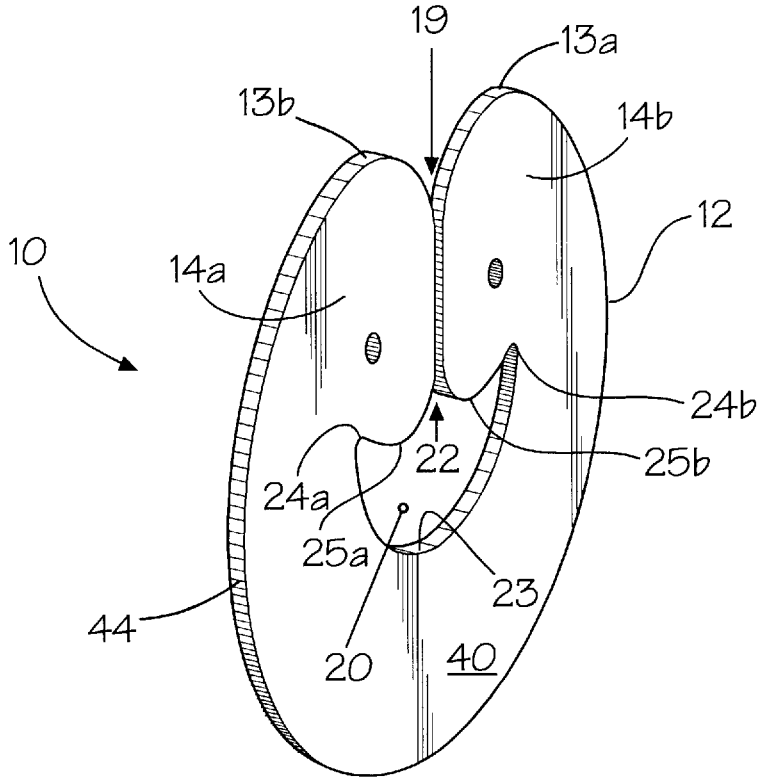
FIG. 7 illustrates a perspective view of the present invention.
Figure 9:
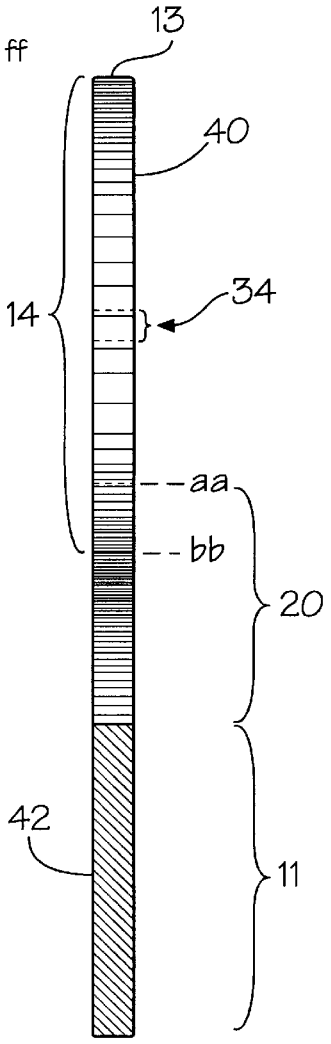
FIG. 9 illustrates a cross-sectional view of FIG. 8.
Figure 10:
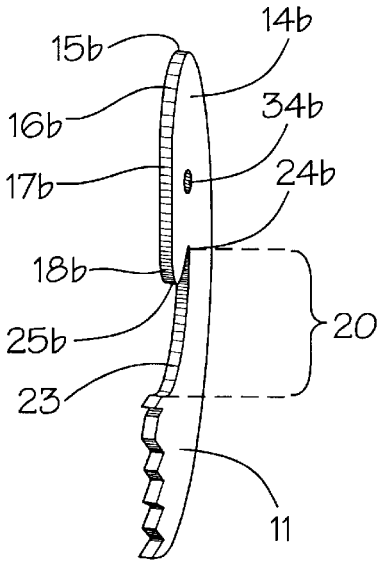
FIG. 10 illustrates a sectional view of FIG. 8.

The present invention 10 has a front surface 40, FIG. 7, and a back surface 42, FIG. 9. The front surface 40 and the back surface 42 are substantially flat and are separated by the thickness of the wafer-like body 11.

The present invention 10 has a continuous outer wall 44, FIG. 7. The general shape of the outer wall 44 is defined by the peripheral edge 12 that generally circumnavigates the outer portion of the wafer-like body 11. The cross-sectional area of the thickness of the wafer-like body 11 defines the surface of the outer wall 44. The outer wall 44 joins lobe walls 15*a* and 15*b* at point 13*a* and 13*b* respectively.

The lobes 14*a* and 14*b* are divided into three distinct sections or portions defined by the lobe walls 15*a*, 15*b*, and the guiding surfaces 25*a* and 25*b*. The guiding surface 25*a* and 25*b* are contiguous to the lobe walls 15*a* and 15*b* and adjoin at points bb and dd, FIG. 8, respectively. The lobe walls 15*a* and 15*b* have an upper wall section 16*a* and 16*b*, a middle section 17*a* and 17*b*, and a lower portion 18*a* and 18*b*. The combination of lobe walls 15*a* and 15*b* and guide surfaces 25*a* and 25*b* define respective lobes 14*a* and 14*b*. All lobe portions are contiguous and homogeneous to the wafer-like body 11.

Figure 8:
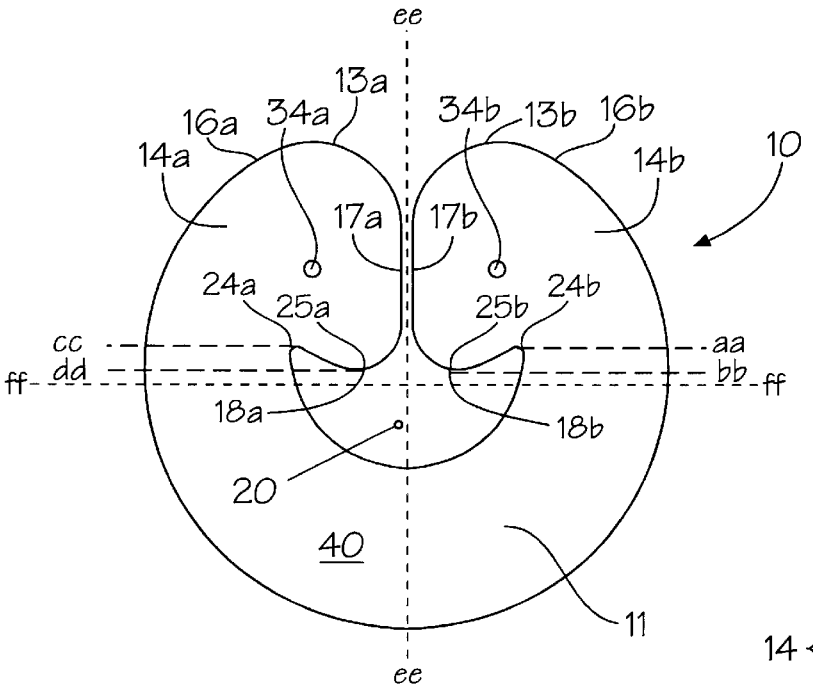
FIG. 8 illustrates a front view of FIG. 7.

The cross-sectional area of the aperture 20, FIG. 8, is generally defined by a composite of overlapping surrounding shapes. Each shape has a distinct cross-sectional area and when overlapped the shapes combine to yield the total cross-sectional area surrounding the aperture 20. The periphery of the generally semi-circular shape of aperture 20 extends from the end points aa to cc along the interior wall 23, FIG. 8. The end points of aa and cc may, if desired, be equal distant from the vertical center line ee, FIG. 8. The end points aa and cc are parallel to a horizontal plane ff that is perpendicular to the center line ee.

The second cross-sectional shape that defines the aperture 20 is the lower portion of lobes 14*a* and 14*b* defined by lower wall portions 18*a* and 18*b* and guide surfaces 25*a* and 25*b*. The end portion of the lobes 14*a* and 14*b* may, if desired, be equal distant from the center line ee. The end portion of the lobes 18*a* and 18*b* is perpendicular to the horizontal plane ff and projects into the aperture 20 generally defined at the end points bb and dd respectively. The end points bb and dd are oppositely spaced from the end points aa and cc along guide surfaces 25*a* and 25*b* respectively. The guide surfaces 25*a* and 25*b* intersect the aperture wall 23 at points aa and cc respectively to form vertices or niches 24*a* and 24*b*. The lobes 14*a* and 14*b* may be of any cross-sectional area that allows the guiding of bag handles around the end portions 18*a* and 18*b* into respective niches 24*a* and 24*b*. The respective end portion of lobes 14*a* and 14*b* project into the aperture 20 substantially greater than the respective niches 24*a* and 24*b*. The aperture wall 23 and guide surfaces 25*a*, 25*b* adjoining the lobe walls 15*a*, 15*b* respectively define the perimeter of the cross-sectional area of the aperture 20.

A linear view of the positional relationships between the various aspects of the present invention 10, FIG. 8 are illustrated as a cross-sectional view, FIG. 9. The longitudinal length of the lobe 14 extends from break point 13 to the point bb. The point bb denotes the end point of the depth of the projection of lobe 14 into the interior of the aperture 20. The vertex 24 formed by the intersection of the aperture wall 23 and the guide surfaces 25 denoted at point aa is positioned above the end point bb. The spaced relationship between end points aa and bb denotes a difference in the projection of lobe 14 into the aperture 20 and projection of the vertex 24 into the aperture 20. The projection of the lobe 14 into the interior of the aperture 20 is substantially greater than the projection of the vertex 24 into the interior of the aperture 20.

While this invention has been described in detail with particular references to the preferred embodiment thereof, it should be understood that many modifications, additions and deletions may be made thereto without departure from the spirit and scope of the invention as set forth in the following claims.

I claim:

1. A clasp releasably securing handles of a bag, comprising:

a) a wafer-like body having an outer peripheral edge;

b) two lobes in said body defined by generally C-shaped walls extending from said outer peripheral edge and disposed in spaced-apart backward-facing mirrored relation to define a channel opening into an interior aperture in said body;

c) said lobes each having a lower portion wall, said lower portion wall projecting into the interior of said aperture;

d) two niches, each on opposite sides of said channel, each niche having a first wall defined by said respective lower portion wall;

e) said niches each having a respective second wall defined by a respective side wall portion of the body defining said interior aperture;

f) said first and second walls intersecting and forming respective vertices, said vertices oppositely disposed from said respective lobe's lower portion end points;

g) said respective lobe's lower portion wall endpoint projecting into said aperture's interior, said projection being substantially greater than said respective vertex projection into said aperture's interior;

h) thereby the handles traversing said channel into the interior of said aperture being guided by said lobes into said niches releasably securing the bag.

2. The clasp of claim 1 wherein said niches are generally V-shaped.

* * * * *